US005264819A

United States Patent [19]

Nied et al.

[11] Patent Number: 5,264,819

[45] Date of Patent: Nov. 23, 1993

[54] HIGH ENERGY ZINC OXIDE VARISTOR

[75] Inventors: Herman F. Nied, Clifton Park; Howard F. Ellis, Queensbury, both of N.Y.

[73] Assignee: Electric Power Research Institute, Inc., Palo Alto, Calif.

[21] Appl. No.: 988,348

[22] Filed: Dec. 9, 1992

Related U.S. Application Data

[63] Continuation of Ser. No. 626,308, Dec. 12, 1990.

[51] Int. Cl.[5] ..... H01C 7/10

[52] U.S. Cl. ..... 338/21; 338/20; 338/322; 338/332

[58] Field of Search ..... 338/20, 21, 322, 332

[56] References Cited

U.S. PATENT DOCUMENTS

| | | | |
|---|---|---|---|
| 3,138,686 | 6/1964 | Mitoff et al. . | |
| 3,210,546 | 10/1965 | Perron . | |
| 3,448,267 | 6/1969 | Blythe et al. . | |
| 3,720,832 | 3/1973 | Apple . | |
| 3,803,413 | 4/1974 | Vanzetti et al. . | |
| 3,868,508 | 2/1975 | Lloyd . | |
| 3,905,006 | 9/1975 | Matsuoka et al. . | |
| 3,991,302 | 11/1976 | Donner . | |
| 4,031,498 | 6/1977 | Hayashi et al. | 338/21 |
| 4,272,411 | 6/1981 | Sokoly et al. . | |
| 4,371,860 | 2/1983 | May et al. . | |
| 4,423,404 | 12/1983 | Goedde et al. . | |
| 4,450,426 | 5/1984 | Miyoshi et al. | 338/21 |
| 4,451,815 | 5/1984 | Sakshaug et al. . | |
| 4,460,497 | 7/1984 | Gupta et al. . | |
| 4,692,735 | 9/1987 | Shoji et al. . | |
| 4,733,175 | 3/1988 | Levinson | 324/158 |
| 4,737,917 | 4/1988 | Perron . | |

FOREIGN PATENT DOCUMENTS

| | | |
|---|---|---|
| 54-139095 | 10/1979 | Japan . |
| 1-216504 | 8/1989 | Japan . |

OTHER PUBLICATIONS

*The Condensed Chemical Dictionary;* 9th Ed. 1977, pp. 340, 355, 518–519.

*Primary Examiner*—Marvin M. Lateef

*Attorney, Agent, or Firm*—Flehr, Hohbach, Test, Albritton & Herbert

[57] ABSTRACT

A varistor with a body including an outer perimeter and substantially parallel opposed ends is surrounded on its outer perimeter by a collar formed from a high temperature polymer. Electrodes are fixed to the parallel opposed ends of the varistor such that they extend at least to the interior edge of the collar. A method of making the varistor is also described.

6 Claims, 3 Drawing Sheets

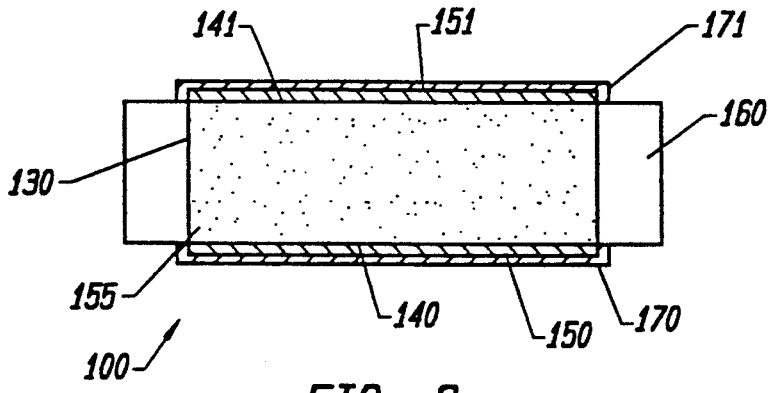
FIG. 3
FIG. 4
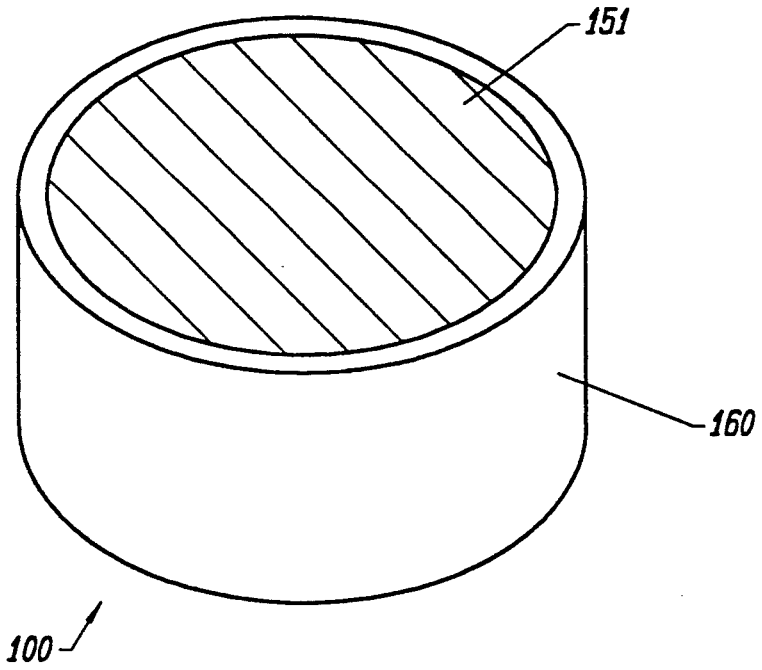
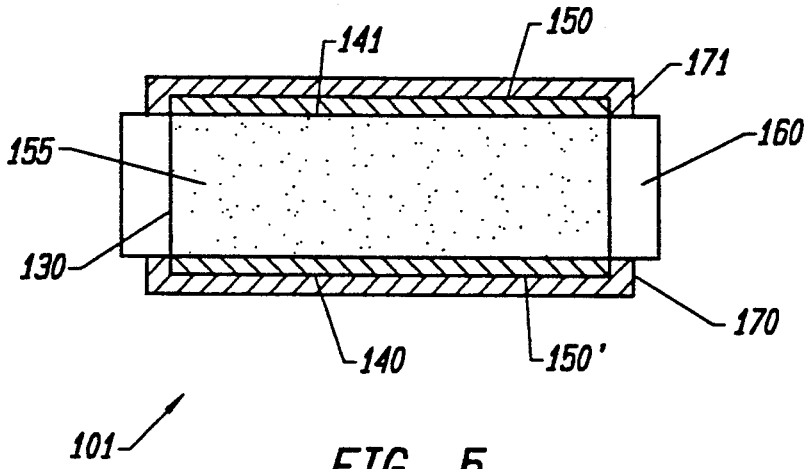
FIG. 5

HIGH ENERGY ZINC OXIDE VARISTOR

This is a continuation of application Ser. No. 07/626,308 filed Dec. 12, 1990.

BACKGROUND OF THE INVENTION

1. Field of the Invention

The present invention relates to a disc shaped, zinc oxide-based varistor for high voltage or high current applications, and more particularly relates to improvements in the physical stability thereof.

2. Description of the Prior Art

A zinc-oxide-based varistor, as typically manufactured, comprises a sintered disc of zinc oxide and additives, the disc having a pair of electrodes on opposite faces. It is also typical for the electrode on the face to only 22 extend part way to the rim of the disc, in order to avoid arcing, also called fringing current or flash over. See, for example, U.S. Pat. Nos. 4,460,497 to Tapan K. Gupta et al., 4,451,815 to Eugene Sakshaug et Ano., and 4,450,426. In addition, the rim is usually protected from the elements or some aspect of the manufacturing process by an electric insulator. See, for example U.S. Pat. Nos. 4,371,860 to John E. May et Ano., and 3,138,686 to Steven P. Mitoff et Ano.

The zinc oxide varistor exhibits a non-linear current-voltage relationship, thought to be in the form $I=C\times V^a$, where "a" is greater than 1. In other words, it acts as an insulator for low voltages, and as a conductor for high voltages. It thereby provides overvoltage protection or acts as a voltage stabilizer, surge absorber or arrester, and may be subjected to current surges.

Because of Joule heating, the interior of the disc may reach a high temperature while the rim remains close to ambient temperature. The situation is exacerbated by the anti-arcing design in which the margin of the face is left bare. The electric field drops suddenly near the rim, as does the temperature, resulting in a thermal shock condition. This may result in physical cracking on the rim, and substantial damage to the device.

The following patents are hereby referenced as being typical of known prior art in so far as they disclose means for discouraging arcing and thereby minimize this problem and in which it appears that the electrode extends at least as far as the rim:

| U.S. Pat. No. | Inventor |
|---|---|
| 4,692,735 | Moritaka Shogi et al. |
| 4,423,404 | Gary L. Goedde et Ano |
| 4,272,411 | Theodore O. Sokoly et Ano |
| 3,905,006 | IGA Atsushi, et al |

In Shogi, Goedde and U.S. Pat. No. 3,905,006, the process for manufacturing and attaching the insulator is complicated and may involve temperatures over 500 degrees C., which may damage the varistor.

It is an object of this invention to provide an improved zinc oxide varistor disc which has more uniform Joule heating without causing arcing between the face electrodes, and which is thus less likely to crack on the rim and thus would provide more stability than prior art zinc varistor discs.

It is a further object of this invention to provide a system based on infrared thermal measurements to predict the energy handling capacity of a particular varistor disc.

DETAILED DESCRIPTION OF THE DRAWINGS

FIG. 3 is a cross section view of a zinc oxide varistor in accordance with the present invention.

FIG. 4 is a prospective view of the zinc oxide varistor illustrated in FIG. 3.

FIG. 5 is a perspective view of the zinc oxide varistor comprising a second embodiment of the invention.

DETAILED DESCRIPTION OF THE INVENTION

Figure 1:
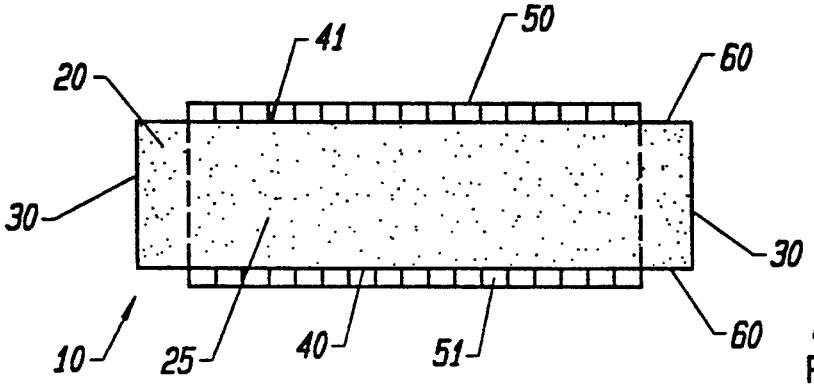
FIG. 1 PRIOR ART
FIG. 1 is a cross section view of a prior art zinc oxide varistor.
Figure 2:
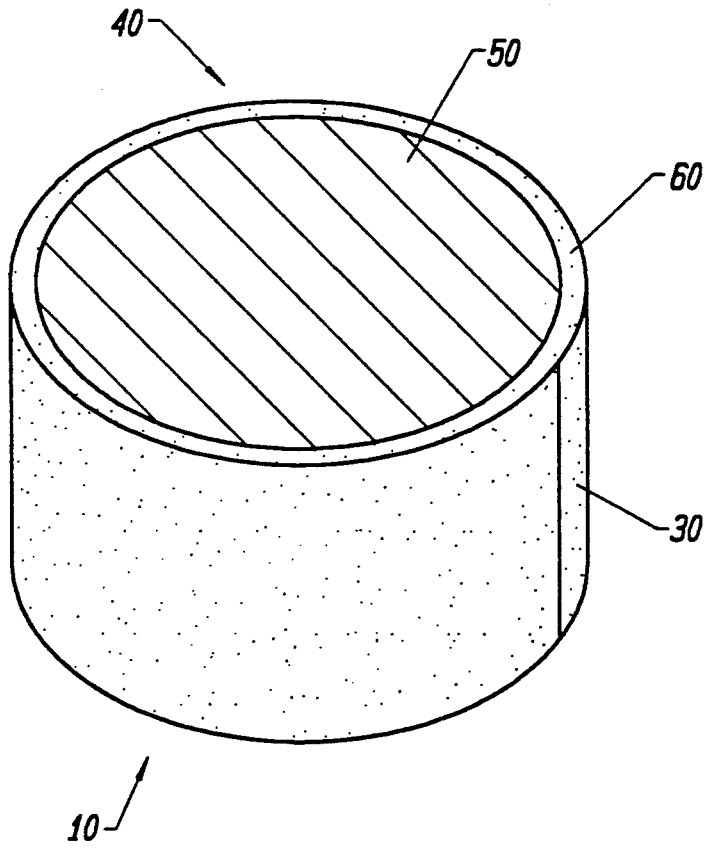
FIG. 2 PRIOR ART
FIG. 2 is a perspective view of the prior art zinc oxide varistor shown in FIG. 1.

Referring now to the drawings, FIGS. 1 and 2 illustrate the prior art zinc oxide varistor, generally indicated at 10. This varistor comprises a disc of sintered zinc-oxide and additives, the disc having a bulk interior 25 and a cylindrical surface 30 extending between the opposite faces 40 and 41. A pair of electrodes 50 and 51 are affixed to the opposite faces 40 and 41, but extend only part-way to the cylindrical surface 30 in order to avoid arcing. The margin 60 is that part of the face 40 not covered by the electrodes. The cylindrical surface 30 is generally covered with an insulator (not shown), usually a thin glass coating, to protect it from the elements or some aspect of the manufacturing process.

When the prior art varistor 10 is exposed to high current for a short period of time, the interior 25 of the disc will have a generally uniform electric field. The margin region 60 is narrow and will be subject to a severe electric field gradient.

Because of Joule heating the interior 25 may briefly reach a temperature as high as 160 degrees C. above the ambient temperature. The regions of the disc near the cylindrical surface 30 will remain near ambient temperature since any heat would be rapidly dissipated to the environment. Additionally, this region has a significantly lower current flow. Due to the current gradient and the dissipation characteristics of the disc severe thermal gradients may develop across the disc. These thermal gradients may produce a thermal shock condition, which may result in physical cracking of the disc.

FIGS. 3 and 4 illustrate a zinc oxide varistor of known composition according to the present invention, generally indicated at 100. The varistor comprises a disc-shaped body 155 of sintered zinc-oxide and additives, the disc having a cylindrical outer surface 130 and opposite faces 140 and 141. A pair of electrodes 150 and 151 are affixed opposite faces 140 and 141 and extend up to the edge of the outer cylindrical surface 130. A collar 160 with high dielectric and high temperature insulating properties is then positioned around the outer cylindrical surface 130. In the preferred embodiment, the collar 160 is a high temperature polymer.

The collar 160 may be made of polyetherimide (ULTEM) which has a high dielectric strength of 33 KV/mm in air @1.6 mm. Polyetherimide is a high temperature polymer which can be used in applications where the temperature goes above 210° C., well within the range of expected use. Metal coatings 170 and 171 extend across the top 14 and bottom electrodes 150 and 154 and the junction between the polyetherimide collar 160 and the disc 110 and may be formed by one of a variety of techniques, such as vacuum metallization, flame/arc spraying. This metal coating effectively forms an extension to the electrodes (150, 151) and produces a more uniform electric field gradient across the disc body 155. In other embodiments, the collar 160 is made of porcelain enamel, thermal plastic or a suitable polymer.

Polyetherimide has a higher coefficient of expansion than zinc oxide, so if a polyetherimide collar is used, it will fit snugly on the disc 100 upon cooling down, and it will be in a state of tension while slightly compressing the disc 100.

FIG. 5 illustrates another embodiment of the invention, differing from the embodiment discussed above in that the electrodes 140 and 141 do not extend outwardly beyond the cylindrical surface 130.

When the varistor 100 according to the present invention is exposed to high current or voltage, the interior of the disc will have a generally uniform electric field tending to equalize the current distribution. This is a result of the electrodes extending entirely across the faces of the disc. Problems due to high electric fields in the regions near the outer cylindrical surface are reduced by the high dielectric properties of the collar. This results in more uniform heating of the varistor disc for a given current and dissipation while reducing arcing problems associated with prior electrodes when they extended to or beyond the cylindrical surface.

Accordingly, Joule heating is more uniformly distributed throughout the disc, resulting in a lower thermal gradient across the disc. Reducing the thermal gradient reduces susceptibility to physical cracking caused by a thermal shock condition, common in prior art varistors.

The present invention further provides a method for determining the energy handling capacity of a particular disc, that is the disc's resistance to cracking, prior to assembly of the varistor. This permits discs having low or unacceptable dissipations to be discarded to improve the quality of finished varistors.

It is known from both experiment and analysis that those varistor discs which are most resistant to cracking exhibit axisymmetric Joule heating when a voltage is applied across their faces. Conversely, those varistors which are least resistant to cracking exhibit non-symmetric temperature distributions upon Joule heating, which distributions result in thermal stress which can crack the discs. It is also known that temperature contours on zinc oxide disc varistors subjected to high energy pulses are similar to those seen after relatively low energy inputs over a longer period of time.

Figure 6:
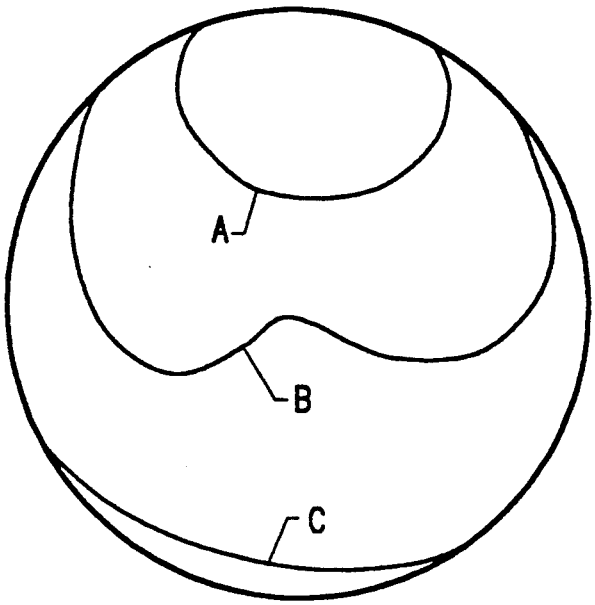
FIG. 6 is a drawing illustrating the contours of equal temperature of a typical varistor.

FIG. 6 is a drawing illustrating typical curves corresponding to constant temperature patterns, thermometry across the face of a typical varistor disc. In this illustration only three curves, labeled "A", "B" and "C" are illustrated. However, in most applications more profiles may be used. These profiles are used to predict the stability of the finished varistor, as described below.

Figure 7:
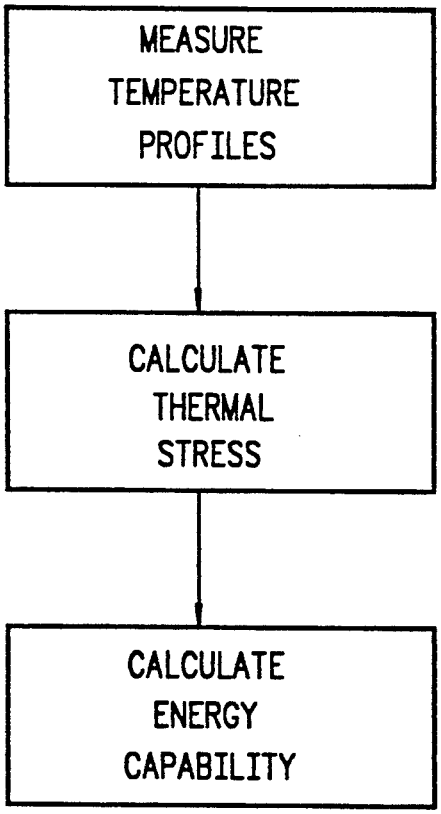
FIG. 7 is a block diagram illustrating the process for predicting the thermal stability of a varistor disc.

FIG. 7 is a block diagram illustrating the process used to evaluate the thermal characteristics of a particular varistor disc. Each of the newly manufactured zinc oxide varistor disc 195 is subjected to a low energy pulse. For example, rapid application of 27 kJ energy will increase the average temperature of the varistor by about 60 degrees C. The thermograph is produced using an infrared camera recorder and converted to digital form. This data is analyzed by a digital computer to determine the thermal stress of the varistor disc.

More specifically, the thermal stress analysis involves calculating the thermal stress at various locations on the varistor disc, and especially on and near the outer cylindrical surface, as this is the region of expected maximum stress. All calculations in this thermal stress calculation step are performed directly from the thermal data, previously described. That is they are performed in closed form, and thus need very little computer memory, and numerical results are obtained rapidly. Once the thermal stresses near the outer cylindrical surface have been calculated, the energy handling capability step compares this data with a known physical properties of the material, and determines the maximum energy handling capability of the particular disc. Any disc having a thermal capability lower than the desired value are discarded. This permits varistors of a given capability to be manufactured with a lower disc volume.

We claim:

1. A varistor comprising:
   - a body including an outer perimeter and substantially parallel opposed ends;
   - a collar positioned around said outer perimeter of said body, said collar being formed from a high temperature polymer; and
   - first and second electrodes respectively affixed to said opposed ends, said electrodes extending at least to the interior edge of said collar.

2. The varistor of claim 1 wherein said collar is polyetherimide.

3. A varistor comprising:
   - a body including an outer perimeter and substantially parallel opposed ends;
   - a collar positioned around said outer perimeter of said body, said collar being formed from a material selected from the group consisting of: porcelain enamel and thermal plastic; and
   - first and second electrodes respectively affixed to said opposed ends, said electrodes extending at least to the interior edge of said collar.

4. The varistor of claim 1 or 3 wherein a metal coating is deposited o top of said first and second electrodes.

5. A method of forming a varistor, said method comprising the steps of:
   - subjecting a varistor disc to a low energy pulse;
   - utilizing an infrared camera to generate thermal distribution energy data corresponding to said varistor disc;
   - calculating thermal stress data for said varistor disc based on said thermal distribution data;
   - selecting a functional varistor disc based upon said thermal distribution data; and
   - affixing electrodes to opposed surfaces of said varistor disc, said electrodes extending at least to the respective edges of said opposed surfaces.

6. The method of claim 5 further comprising the step of:
   - attaching a high dielectric constant, high thermal insulation collar around the body of said varistor disc.

* * * * *